US011732423B2

(12) United States Patent
Constantine

(10) Patent No.: US 11,732,423 B2
(45) Date of Patent: Aug. 22, 2023

(54) SPRING ANCHOR ASSEMBLY FOR TRACK RAIL AND SPRING ANCHOR INSULATOR FOR SAME

(71) Applicant: Progress Rail Services Corporation, Albertville, AL (US)

(72) Inventor: Edward Constantine, Belton, MO (US)

(73) Assignee: Progress Rail Services Corporation, Albertville, AL (US)

( * ) Notice: Subject to any disclaimer, the term of this patent is extended or adjusted under 35 U.S.C. 154(b) by 524 days.

(21) Appl. No.: 16/870,564

(22) Filed: May 8, 2020

(65) Prior Publication Data

US 2021/0348340 A1 Nov. 11, 2021

(51) Int. Cl.
*E01B 13/02* (2006.01)
*E01B 9/02* (2006.01)

(52) U.S. Cl.
CPC ..... *E01B 13/02* (2013.01); *E01B 9/02* (2013.01); *E01B 2201/08* (2013.01)

(58) Field of Classification Search
CPC ..... E01B 9/02; E01B 13/02; E01B 2201/08
See application file for complete search history.

(56) References Cited

U.S. PATENT DOCUMENTS 3,610,526 A 10/1971 Burwell
7,147,169 B2 12/2006 Walsh
7,744,009 B2 * 6/2010 Reed ..... E01B 13/02 238/351
7,744,010 B2 6/2010 Reed

FOREIGN PATENT DOCUMENTS

KR 100614949 B1 8/2006

* cited by examiner

*Primary Examiner* — Robert J McCarry, Jr.

(57) ABSTRACT

A spring anchor assembly for fastening track rail includes a spring anchor having a hook end, a tail end, and a middle section. An insulator is fitted upon the spring anchor and includes a plurality of rib walls extending fore and aft between a first outer insulator wall and a second outer insulator wall. The outer insulator walls form downward depending wall sections extending, respectively, from termination locations of the rib walls to the lower peripheral edges. A channel is formed between the wall sections and receives the middle section, contacted by the plurality of rib walls at the termination locations. The insulator insulates the spring anchor to limit leaking electrical currents from the track rail to ground.

17 Claims, 4 Drawing Sheets

SPRING ANCHOR ASSEMBLY FOR TRACK RAIL AND SPRING ANCHOR INSULATOR FOR SAME

TECHNICAL FIELD

The present disclosure relates generally to anchoring mechanisms used in track rail, and more particularly to a spring anchor assembly including a spring anchor and an insulator fitted upon the spring anchor.

BACKGROUND

Rail equipment is used across the world for transportation of persons and all manner of goods and equipment. Rail lines for freight or passenger service are formed by parallel track rails supported upon a substrate or "ballast," typically by fixation to ties. Depending upon the design of the rail line and the type of substrate and supporting materials, including concrete ties versus wooden ties, use of gravel, concrete or other materials, a variety of different mechanisms are used for positioning, supporting, and fastening track rails and managing loads and vibrations transmitted between rail equipment and the underlying substrate.

Rail fastening and fixation systems range from simple plates that attach rails to wooden ties by way of spikes, to highly engineered direct fixation fasteners formed from an assembly of metallic and non-metallic components. Direct fixation fasteners are typically used to clamp a section of track rail to underlying concrete such as a concrete tie. The direct fixation fasteners will typically cushion the track rail and limit lateral movement, often providing for some degree of lateral adjustability as rail gauge changes based upon material wear over time.

Other rail fastening and anchoring components are often used to prevent shifting or migration of track rail in a fore and aft direction, and can include devices known as spring anchors that are clamped to a section of track rail upon a forward side and a back side of a concrete tie, for example. One known spring anchor design is set forth in U.S. Pat. No. 7,744,009 to Reed et al. Reed provides an isolator adapted for use with a rail anchor in applications where rail is installed on concrete ties. The isolator apparently protects the concrete tie from contact with the rail anchor caused by longitudinal movement of the rail. While the design set forth in Reed et al. may address certain concerns, there is always room for improvements and alternative strategies in the field.

SUMMARY OF THE INVENTION

In one aspect, a spring anchor assembly for fastening track rail upon a tie includes a spring anchor having an elongate spring body with a hook end, a tail end, and a middle section. The spring anchor assembly also includes an insulator fitted upon the spring anchor and including an upper insulator side exposed between the hook end and the tail end, a lower insulator side, and a first outer insulator wall and a second outer insulator wall extending downward from the upper insulator side. The first outer insulator wall and the second outer insulator wall each include an upper peripheral edge extending along the upper insulator side, and a lower peripheral edge extending curvilinearly along the lower insulator side. The insulator further includes a plurality of rib walls extending fore and aft from the first outer insulator wall to the second outer insulator wall, and downward from the upper insulator side to termination locations spaced upward from the lower peripheral edges. The first outer insulator wall and the second outer insulator wall form a first downward depending wall section and a second downward depending wall section extending, respectively, from the termination locations to the lower peripheral edges. A channel is formed fore and aft between the first downward depending wall section and the second downward depending wall section. The middle section of the elongate spring body is received in the channel and contacted by the plurality of rib walls at each of the termination locations.

In another aspect, a spring anchor insulator includes an insulator body having an upper insulator side with an upper insulator surface extending between a first lateral insulator end and a second lateral insulator end, and a lower insulator side. The insulator body further includes a first outer insulator wall and a second outer insulator wall each including an upper peripheral edge extending linearly along the upper insulator side, and a lower peripheral edge extending curvilinearly along the lower insulator side. The insulator body further includes a plurality of rib walls extending fore and aft from the first insulator wall to the second insulator wall, and downward from the upper insulator side to termination locations spaced upward from the lower peripheral edges. The first outer insulator wall and the second outer insulator wall form a first downward depending wall section and a second downward depending wall section extending from the termination locations to the respective lower peripheral edges. A channel is formed fore and aft between the first downward depending wall section and the second downward depending wall section and has a curvilinear shape between the first lateral insulator end and the second lateral insulator end to receive a curved middle section of a spring anchor.

In still another aspect, a spring anchor insulator includes an insulator body having an upper insulator side with an upper insulator surface extending between a first lateral insulator end and a second lateral insulator end, and a lower insulator side. The insulator body further includes a first outer insulator wall and a second outer insulator wall spaced apart in a fore and aft direction. The first outer insulator wall and the second outer insulator wall each include a planar outer face, an upper peripheral edge extending along the upper insulator side, and a lower peripheral edge extending along the lower insulator side. The insulator body further includes a plurality of anchor contact surfaces arranged in a curvilinear pattern between the first lateral insulator end and the second lateral insulator end, and spaced upwardly from the lower peripheral edges so as to form a channel between the first outer insulator wall and the second outer insulator wall, for receiving a curved middle section of a spring anchor.

DETAILED DESCRIPTION

Figure 1:
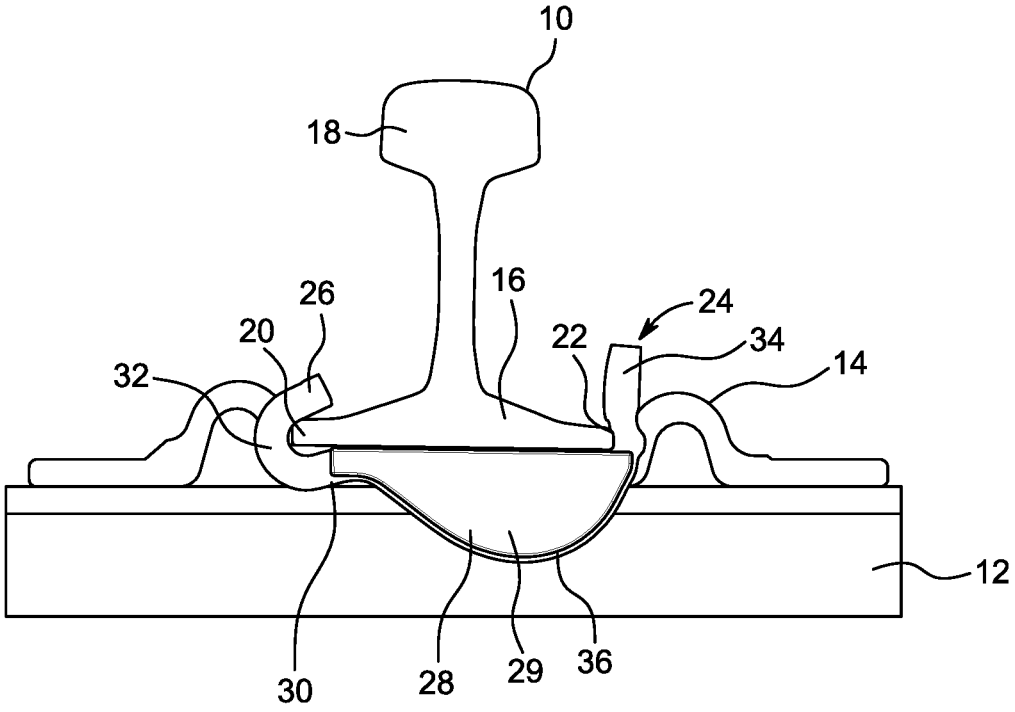
FIG. 1 is a diagrammatic front view of a track rail fastened to a tie with a fastener, and anchored with a spring anchor assembly, according to one embodiment.

Referring to FIG. 1, there is shown a track rail 10 fastened to a tie 12 by way of a fastener 14, and anchored against longitudinal displacement by way of a spring anchor assembly 24. Tie 12 will typically include a conventional concrete tie, with fastener 14 including any suitable fastener but typically a direct fixation fastener attached to tie 12 by way of bolts, and clamping track rail 10 upon a rail plate of fastener 14. Track rail 10 includes a base 16, a head 18, a first lateral base edge 20 and a second lateral base edge 22. Spring anchor assembly 24 includes a spring anchor 26 having an elongate spring body 30 formed, for example, of steel, and having a hook end 32, a tail end 34, and a middle section 36. An insulator 28 is also part of spring anchor assembly 24 and is fitted upon spring anchor 26. Insulator 28 may include a one-piece insulator body 29 formed, for example, of an insulator material such as a rubber or rubber-like material, or any of a variety of other suitable polymeric materials. Insulator body 29 will typically be injection molded and may be fitted upon spring anchor 26 as original equipment or placed upon spring anchor 26 in the field prior to installation, as further discussed herein.

Figure 2:
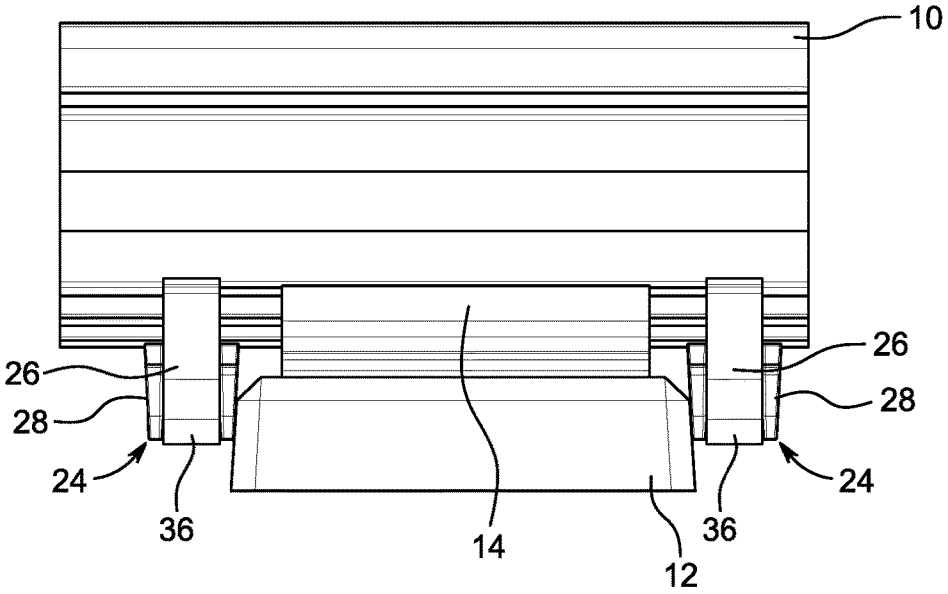
FIG. 2 is a side diagrammatic view of a track rail fastened and anchored to a tie with a fastener and spring anchors, similar to FIG. 1.
Figure 3:
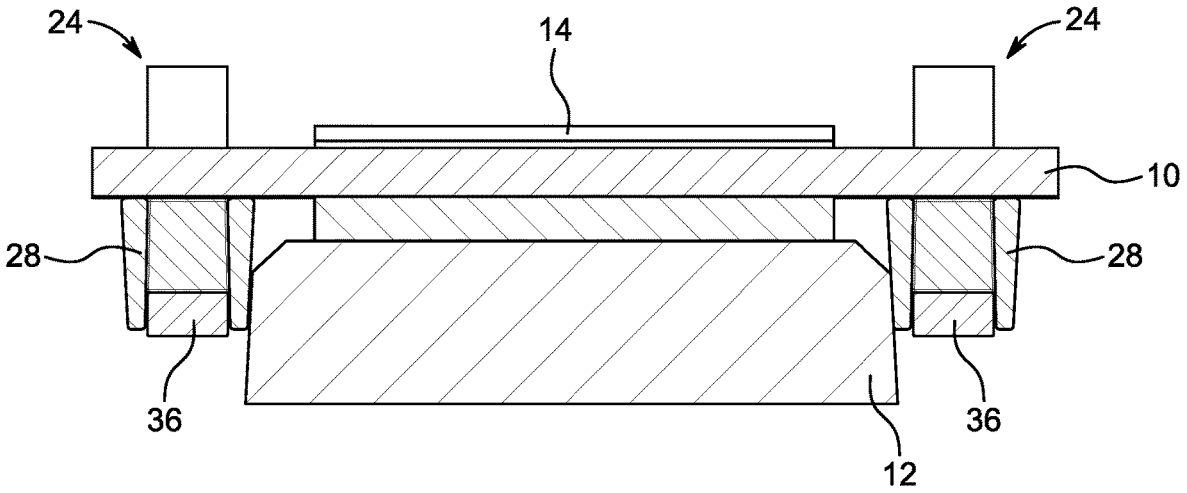
FIG. 3 is a sectioned view through the elements of FIG. 2.

Referring also now to FIGS. 2 and 3, spring anchor assembly 24 may be one of two identical spring anchor assemblies positioned, for example, at fore and aft sides of tie 12. Anchoring of track rail 10 using spring anchor assemblies 24 at fore and aft locations can fix track rail 10 against longitudinal displacement, to the left or to the right in the illustrations of FIG. 2 and FIG. 3. It can further be noted from the Figures that hook end 32 receives first lateral base edge 20, and that tail end 34 couples with second lateral base edge 22. In a practical implementation strategy, spring anchor 26 is installed, using an installation machine, for example, by positioning hook end 32 about first lateral base edge 20, and then swinging elongate spring body 30 beneath the track rail until tail end 34 slides upward against second lateral base edge 22 and is engaged with second lateral base edge 22. Tail end 34 may be urged upwardly to deform middle section 36 in opposition to an internal bias, until tail end 34 catches upon second lateral base edge 22.

Figure 4:
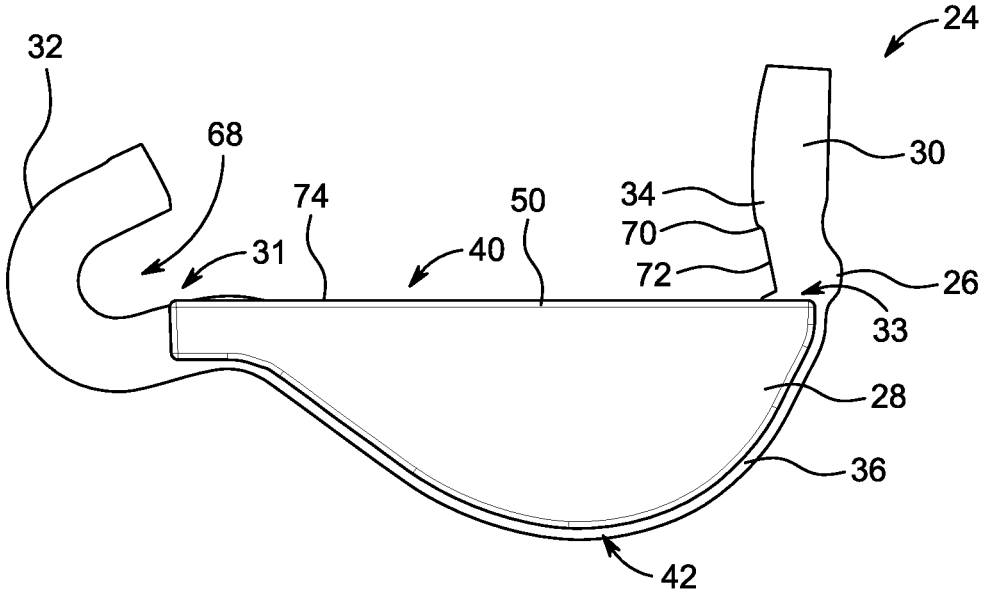
FIG. 4 is a diagrammatic view of a spring anchor assembly, according to one embodiment.
Figure 5:
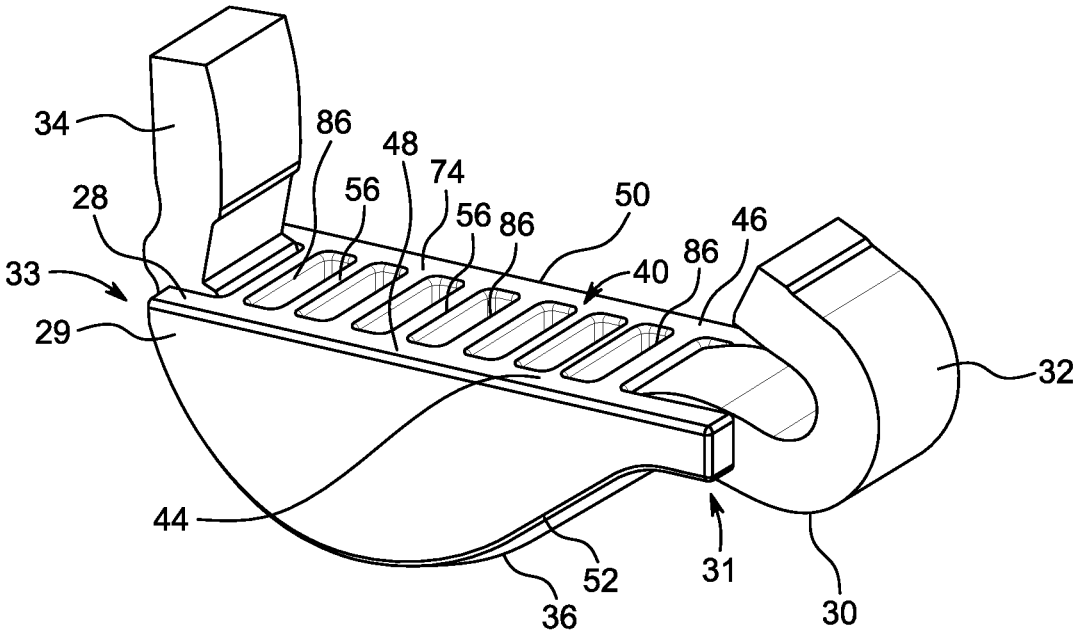
FIG. 5 is another diagrammatic view of the spring anchor assembly of FIG. 4.

Referring now also to FIG. 4, hook end 32 may have a recurving shape, in other words such that elongate spring body 30 curves back upon itself, and forms a hook slot 68 opening inward, to receive first lateral base edge 20. Tail end 34 extends upward and includes a catch surface 70 facing downward, or having a downward and inward slant, for example, to catch upon an upper surface of second lateral base edge 22. Tail end 34 may include a catch slot 72 forming catch surface 70. Shape and orientation of tail end 34 will thus be understood to enable a spring installation arrangement of spring anchor assembly 24 as opposed to a drive-in installation arrangement as is known from other spring anchors where an anchor abuts a peripheral lateral edge of a rail base rather than an upper surface.

Insulator 28 is fitted upon spring anchor 26 as discussed above, and includes an upper insulator side 40 exposed between hook end 32 and tail end 34, and faces a generally upward direction. Insulator 28 includes one-piece insulator body 29 as noted above. It should be understood that insulator 28 and insulator body 29 are terms used interchangeably herein, and thus a reference to insulator 28 can be understood as a reference to insulator body 29, and vice versa. Insulator 28 further includes a lower insulator side 42, and a first outer insulator wall 44 and a second outer insulator wall 46 extending downward from upper insulator side 40. First outer insulator wall 44 and second outer insulator wall 46 each include an upper peripheral edge 48 and 50, respectively, extending linearly along upper insulator side 40. Each of first outer insulator wall 44 and second outer insulator wall 46 further includes a lower peripheral edge 52 and 54, respectively, extending curvilinearly along lower insulator side 42.

Figure 6:
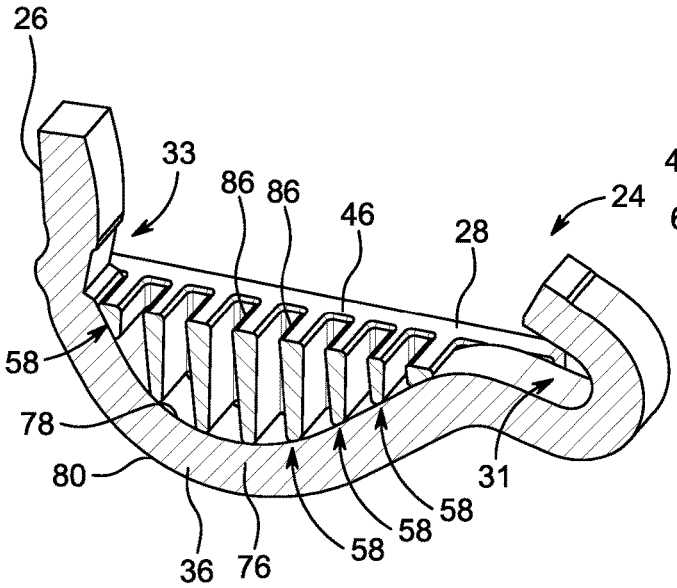
FIG. 6 is a partially sectioned diagrammatic view of a spring anchor assembly in a lateral section plane, according to one embodiment.
Figure 7:
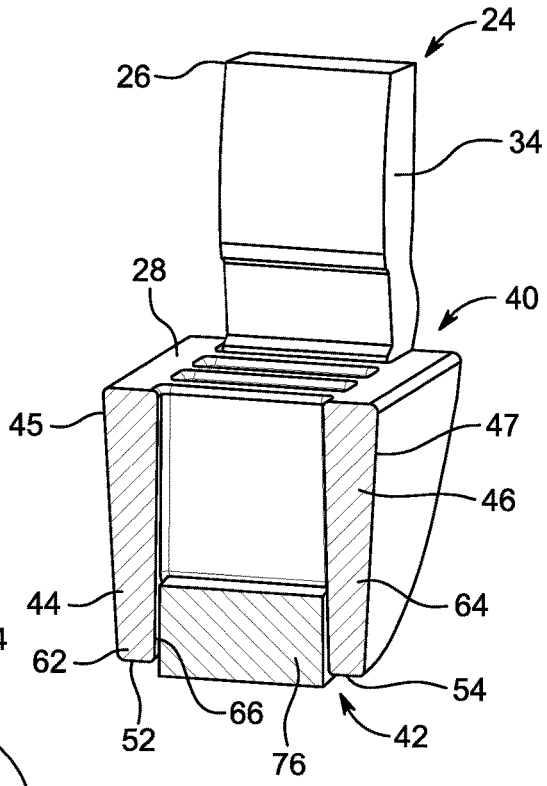
FIG. 7 is a sectioned diagrammatic view of a spring anchor assembly, in a fore and aft section plane.
Figure 8:
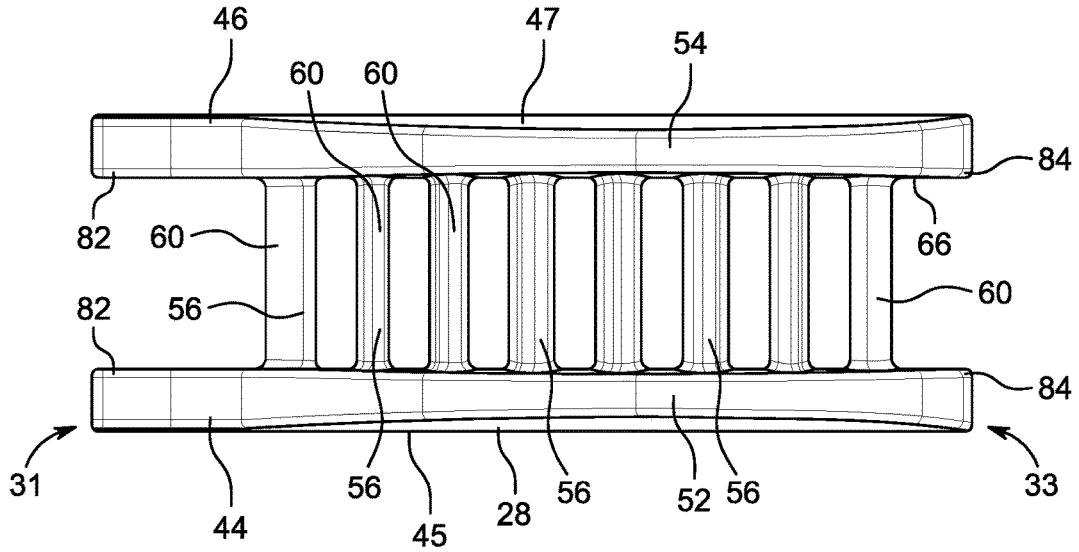
FIG. 8 is a bottom view, in elevation, of an insulator for a spring anchor assembly, according to one embodiment.

Referring now also to FIGS. 6, 7, and 8, each of lower peripheral edges 52 and 54 may form parallel curvilinear paths extending between a first lateral end 31 and a second lateral end 33 of insulator 28 positioned, respectively, adjacent to hook end 32 and tail end 34. The parallel curvilinear paths may be laterally asymmetric, as is readily apparent in FIG. 4. Insulator 28 may be overall left-right or laterally asymmetric, providing for a shape and profiles that fit insulator 28 upon existing spring anchor designs, in only one orientation. The asymmetry and a correct installation orientation of insulator 28 can be readily observed by an installation technician. Such a configuration differs from certain known strategies where insulators were formed symmetric in an effort to enable installation regardless of orientation, but thereby producing disadvantages with regard to fit and material utilization as well as in-service performance. It can also be noted from FIG. 6, for example, that middle section 36 forms a curved belly section 76 having a concave inner surface 78 and a convex outer surface 80. A curvature of middle section 36, in belly section 76, steepens in a direction of tail 34.

Insulator 28 may further include a plurality of rib walls 56 extending fore and aft from first outer insulator wall 44 to second outer insulator wall 46. Rib walls 56 may form, together with first outer insulator wall 44 and second outer insulator wall 46, drain channels 86 opening at upper insulator side 40. Drain channels 86 are elongate fore and aft and may number from 5 to 10, for instance, with a number of drain channels 86 being 7 in the illustrated embodiment. Insulator 28 includes an upper insulator surface 74 that extends, when insulator 28 is fitted upon spring anchor 26, from hook slot 68 to catch slot 72, and may be planar. Drain channels 86 form openings in upper insulator surface 74.

Rib walls 56 further extend downward from upper insulator side 40 to termination locations 58 spaced upward from lower peripheral edges 52 and 54. It can be seen, as in the sectioned view of FIG. 6, that termination locations 58 are arranged in a curvilinear pattern between first lateral insulator end 31 and second lateral insulator end 33. The curvilinear pattern of arrangement will generally follow the curvature of belly section 76 of middle section 36. Insulator 28 may further include a plurality of anchor contact surfaces 60 each formed on one of rib walls 56 at termination locations 58. FIG. 8 illustrates a bottom view of insulator 28. It can be noted from FIG. 8 that an inclination of anchor contact surfaces 60 is varied along the curvilinear pattern of arrangement of termination locations 58. Thus, with the steepening curve in the direction of second lateral insulator end 33 and tail 26, anchor contact surfaces 60 may be more steeply inclined relative to a horizontal plane versus anchor contact surface 60 closer to or at an inflection point of the curvilinear pattern. Analogously, anchor contact surfaces 60 will be steeper closer to first lateral insulator end 31 than anchor contact surfaces 60 at or close to the inflection point of the curvilinear pattern, but not so steeply inclined as the anchor contact surfaces 60 closer or closest to second lateral insulator end 33.

It can also be noted from FIG. 8 that first outer insulator wall 44 and second outer insulator wall 46 form, together with rib walls 56, a ladder shape in the elevation projection illustrated. Each of first outer insulator wall 44 and second outer insulator wall 46 may also include a planar face 45 and 47, respectively. Returning to FIGS. 2 and 3, it can be seen that fore and aft surfaces, planar faces 45 and 47, are formed with a vertical draft that is complementary to a draft formed upon fore and aft sides of tie 12. The draft, and freedom of obstructing protrusions or the like, assists in spring anchor assemblies 24 being smoothly rotated into place and fitting complementarily against the fore and aft sides of tie 12.

Returning to the drawings generally, first outer insulator wall 44 and second outer insulator wall 46 form a first downward depending wall section 62 and a second downward depending wall section 64 extending, respectively, from the termination locations 58 of rib walls 56 to lower peripheral edges 52 and 54. A channel 66 is formed fore and aft between first downward depending wall section 62 and second downward depending wall section 64. Drain channels 56 open at upper insulator side 40, and to channel 66. Middle section 36, including belly section 76, is received in channel 66 and contacted by rib walls 56 and anchor contact surfaces 60 at each of termination locations 58. It will thus be appreciated that downward depending wall sections 62 and 64 can be understood to flank fore and aft sides of elongate spring body 30. It will be recalled that spring anchor assembly 24 is structured to anchor track rail 10 against displacement in a longitudinal, fore and aft direction. Accordingly, downward depending wall sections 62 and 64, depending upon which side is adjacent to a tie, can provide electrical and physical insulation between spring anchor 26 and tie 12, and thus between track rail 10 and the underlying substrate as further discussed herein. As noted above, termination locations 58 define a curve that is parallel to lower peripheral edges 52 and 54. Accordingly, channel 66 is curved, and may have a generally uniform depth in vertical directions, and a generally uniform width fore and aft between downward depending wall sections 62 and 64. Channel 66 is also typically sized such that curved belly section 76 is not quite completely obscured. In other words, spring anchor 26 is not entirely hidden within channel 66 as can be seen from the drawings. It can also be noted from the Figures that insulator 28 includes wall protrusions 82 that form first lateral insulator end 31. Wall protrusions 82 may be structured as thin, generally rectangular extensions of first outer insulator wall 44 and second outer insulator wall 46 that flank elongate spring body 30 along a transition from middle section 36 to hook end 32 when insulator 28 is installed for service. Channel 66 is generally open at each of first lateral insulator end 31 and second lateral insulator end 33. Second lateral insulator end 33 may be formed by wall sections 84 profiled continuously with lower peripheral edges 52 and 54, and with upper insulator side 40.

INDUSTRIAL APPLICABILITY

Referring to the drawings generally, as noted above insulator 28 can provide physical as well as electrical insulation between spring anchor 26 and an underlying substrate. Spring anchor 26 will typically have metal to metal contact with track rail 10. Most modern track rails are used to conduct electrical signals in support of rail operations, and where there is direct electrical contact by way of a conductive path from the track rail to the ballast, electrical signals in the track rail can be partially diverted to the ground by way of spring anchors if not insulated. This is particularly the case where ties are made of concrete. Insulating the spring anchor from the tie using non-conductive material as discussed herein can mitigate the loss of electrical signals previously observed.

The present disclosure provides not only an insulator that can prevent electrical signal loss in the manner described, but also has various advantages with respect to installation and performance in service. Insulator 28 is symmetric about a middle, laterally extending vertical plane, with body walls having planar outer surfaces 45 and 47 connected by rib walls 56. As also discussed above, the fore and aft sides of insulator 28 formed by outer faces 45 and 47 can have a vertical draft that is similar to a draft on a concrete tie, providing a relatively large bearing surface with a tie and extending the service life of insulator 28. As insulator 28 does not extend spatially beyond spring anchor 26 in a left to right or lateral aspect, or in a vertical aspect below spring anchor 26, the use of mechanized spring anchor installation tools purpose-built for a given spring anchor spatial envelope can be expected to perform without damaging insulator 28. When spring anchor assemblies according to the present disclosure are removed, a technician or a tool may be used to hammer downward upon an upper tip of tail 26. The configuration and fitted, asymmetric shape of insulator 28 upon spring anchor 26 is also contemplated to enable removal of spring anchor assemblies without damaging the insulator. Embodiments are contemplated where spring anchor assemblies are provided for field installation already assembled, where spring anchor and insulator components are coupled together in the field, as well as even potentially retrofit applications where an existing spring anchor can be uninstalled, equipped with an insulator according to the present disclosure, and then reinstalled for service.

The present description is for illustrative purposes only, and should not be construed to narrow the breadth of the present disclosure in any way. Thus, those skilled in the art will appreciate that various modifications might be made to the presently disclosed embodiments without departing from the kill and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A spring anchor assembly for fastening track rail upon a tie comprising:

a spring anchor including an elongate spring body having a hook end, a tail end, and a middle section;

an insulator fitted upon the spring anchor and including an upper insulator side exposed between the hook end and the tail end, a lower insulator side, and a first outer insulator wall and a second outer insulator wall extending downward from the upper insulator side;

the first outer insulator wall and the second outer insulator wall each include an upper peripheral edge extending along the upper insulator side, and a lower peripheral edge extending curvilinearly along the lower insulator side;

the insulator further including a plurality of rib walls extending fore and aft from the first outer insulator wall to the second outer insulator wall, and downward from the upper insulator side to termination locations spaced upward from the lower peripheral edges;

the first outer insulator wall and the second outer insulator wall form a first downward depending wall section and a second downward depending wall section extending, respectively, from the termination locations to the lower peripheral edges;

a channel is formed fore and aft between the first downward depending wall section and the second downward depending wall section; and the middle section is received in the channel and contacted by the plurality of rib walls at each of the termination locations, wherein the plurality of rib walls form drain channels opening at the upper insulator side, and opening to the channel formed by the first downward depending wall section and the second downward depending wall section.

2. The spring anchor assembly of claim 1 wherein the hook end forms a hook slot opening inward, to receive a first lateral edge of a track rail base, and the tail end extends upward and includes a catch surface facing downward, to contact an upper surface of a second lateral edge of the track rail base.

3. The spring anchor assembly of claim 2 wherein:

the tail end includes a catch slot forming the catch surface, and the upper insulator side includes an upper insulator surface extending from the hook slot to the catch slot; and the middle section forms a curved belly section having a concave inner surface in contact with the plurality of rib walls.

4. The spring anchor assembly of claim 3 wherein the termination locations define a curve that is parallel to the lower peripheral edges.

5. The spring anchor assembly of claim 1 wherein:

the lower peripheral edges form parallel curvilinear paths between a first lateral end of the insulator and a second lateral end of the insulator positioned, respectively, adjacent to the hook end and the tail end; and the parallel curvilinear paths are laterally asymmetric.

6. The spring anchor assembly of claim 5 wherein the first lateral end of the insulator includes wall protrusions extending outward and flanking the spring anchor.

7. The spring anchor assembly of claim 1 wherein the drain channels are elongate fore and aft and number from 5 to 10.

8. A spring anchor insulator comprising:

an insulator body including an upper insulator side having an upper insulator surface extending between a first lateral insulator end and a second lateral insulator end, and a lower insulator side;

the insulator body further including a first outer insulator wall and a second outer insulator wall each including an upper peripheral edge extending linearly along the upper insulator side, and a lower peripheral edge extending curvilinearly along the lower insulator side;

the insulator body further including a plurality of rib walls extending fore and aft from the first insulator wall to the second insulator wall, and downward from the upper insulator side to termination locations spaced upward from the lower peripheral edges;

the first outer insulator wall and the second outer insulator wall form a first downward depending wall section and a second downward depending wall section extending from the termination locations to the respective lower peripheral edges; and a channel is formed fore and aft between the first downward depending wall section and the second downward depending wall section and has a curvilinear shape between the first lateral insulator end and the second lateral insulator end to receive a curved middle section of a spring anchor, wherein the plurality of rib walls form drain channels opening at the upper insulator side, and to the channel formed between the first downward depending wall section and the second downward depending wall section.

9. The spring anchor insulator of claim 8 wherein the drain channels are elongate fore and aft and number from 5 to 10.

10. The spring anchor insulator of claim 8 wherein the channel formed between the first downward depending wall section and the second downward depending wall section opens at each of the first lateral insulator end and the second lateral insulator end.

11. The spring anchor insulator of claim 8 wherein the insulator body includes wall protrusions forming the first lateral insulator end.

12. The spring anchor insulator of claim 11 wherein the first outer insulator wall and the second outer insulator wall form, together with the plurality of rib walls, a ladder shape in an elevation projection.

13. The spring anchor insulator of claim 8 wherein the termination locations define a curve that is parallel to the lower peripheral edges, and the lower peripheral edges form parallel curvilinear paths between the first lateral end of the insulator and the second lateral end of the insulator.

14. The spring anchor insulator of claim 13 wherein the parallel curvilinear paths are left-right asymmetric.

15. A spring anchor insulator comprising:

an insulator body including an upper insulator side having an upper insulator surface extending between a first lateral insulator end and a second lateral insulator end, and a lower insulator side;

the insulator body further including a first outer insulator wall and a second outer insulator wall spaced apart in a fore and aft direction;

the first outer insulator wall and the second outer insulator wall each including a planar outer face, an upper peripheral edge extending along the upper insulator side, and a lower peripheral edge extending along the lower insulator side; and the insulator body further including a plurality of anchor contact surfaces arranged in a curvilinear pattern between the first lateral insulator end and the second lateral insulator end, and spaced upwardly from the lower peripheral edges so as to form a channel between the first outer insulator wall and the second outer insulator wall, for receiving a curved middle section of a spring anchor, wherein the plurality of anchor contact surfaces are formed upon a plurality of rib walls forming drain channels extending between the upper insulator side and the lower insulator side.

16. The spring anchor insulator of claim 15 wherein:

the lower peripheral edges form parallel curvilinear paths between the first lateral insulator end and the second lateral insulator end positioned, respectively, adjacent to the hook end and the tail end; and the parallel curvilinear paths are laterally asymmetric.

17. The spring anchor insulator of claim 16 wherein the first outer insulator wall and the second outer insulator wall form, together with the plurality of rib walls, a ladder shape in an elevation projection.

* * * * *